US008491735B2

(12) United States Patent
Murakami et al.

(10) Patent No.: US 8,491,735 B2
(45) **Date of Patent: *Jul. 23, 2013**

(54) STEEL SHEET FOR VITREOUS ENAMELING AND METHOD FOR PRODUCING THE SAME

(75) Inventors: Hidekuni Murakami, Kitakyushu (JP); Satoshi Nishimura, Kitakyushu (JP); Shiro Sanagi, Kitakyushu (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/066,181

(22) Filed: Apr. 7, 2011

(65) Prior Publication Data

US 2011/0186191 A1 Aug. 4, 2011

Related U.S. Application Data

(62) Division of application No. 10/494,150, filed as application No. PCT/JP02/11118 on Oct. 25, 2002, now Pat. No. 7,922,837.

(30) Foreign Application Priority Data

Oct. 29, 2001 (JP) ..... 2001-331265

(51) Int. Cl.
*C21D 8/00* (2006.01)
*C22C 38/16* (2006.01)

(52) U.S. Cl.
USPC ..... 148/648; 420/60; 148/332

(58) Field of Classification Search
USPC ..... 148/648, 332; 420/60
See application file for complete search history.

(56) References Cited

U.S. PATENT DOCUMENTS

| | | | |
|---|---|---|---|
| 3,282,685 | A | 11/1966 | Mayer et al. |
| 3,459,537 | A | 8/1969 | Hornak |
| 3,765,874 | A | 10/1973 | Elias et al. |
| 3,939,013 | A | 2/1976 | Gardner et al. |
| 4,019,929 | A | 4/1977 | Matsudo et al. |
| 4,348,229 | A | 9/1982 | Suemune et al. |
| 5,739,485 | A | 4/1998 | Cholet et al. |

FOREIGN PATENT DOCUMENTS

| | | | |
|---|---|---|---|
| EP | 1 233 079 | A1 | 8/2002 |
| GB | 1 377 655 | A | 12/1974 |
| GB | 1 514 093 | | 6/1978 |
| JP | 01-275736 | | 11/1989 |

(Continued)

OTHER PUBLICATIONS

English Machine Translation of Shibata et al. (JP 07-062211) (1995).*

M. Dzubinsky et al., "Prediction of low carbon steels behaviour under hot rolling service conditions", Acta Materialia 51 (2003) 1801-1808.*

(Continued)

*Primary Examiner* — Jessee R. Roe
(74) *Attorney, Agent, or Firm* — Kenyon & Kenyon LLP

(57) ABSTRACT

The present invention relates to a steel sheet for Vitreous enameling excellent in enameling properties (bubbling and black spot resistance, enamel adhesiveness and fish scale resistance) and workability, and a method for producing the same, and is characterized in that the steel sheet contains, in mass of, C: 0.010% or less, Mn: 0.03 to 1.3%, Si: 0.03% or less, Al: 0.02% or less, N: 0.0055% or less, P: below 0.035%, and S: over 0.025% to 0.08%; and the density change of the steel sheet from before an annealing to after an annealing at 850° C. for 20 hours, in a hydrogen atmosphere is 0.02% or more.

4 Claims, 2 Drawing Sheets

FOREIGN PATENT DOCUMENTS

| | | |
|---|---|---|
| JP | 03-166336 | 7/1991 |
| JP | 07-166295 | 6/1995 |
| JP | 07-062211 | 7/1995 |
| JP | 08-144013 | 6/1996 |
| JP | 01-26843 | 1/2001 |
| JP | 2002-249850 | 9/2002 |

OTHER PUBLICATIONS

Dzubinsky et al., "Prediction of low carbon steels behaviour under hot rolling service conditions", Acta Materialia 51, pp. 1801-1808 (2003).

Davis et al., The ASM Handbook, Carbon and Low-Alloy Steel, Mar. 31, 1990, vol. 1, pp. 6-8, 88-89, and 144.

* cited by examiner

STEEL SHEET FOR VITREOUS ENAMELING AND METHOD FOR PRODUCING THE SAME

CROSS REFERENCE TO RELATED APPLICATIONS

This application is a divisional application under 35 U.S.C. §120 and §121 of U.S. Pat. application Ser. No. 10/494,150, filed Apr. 28, 2004, now U.S. Pat. No. 7,922,837, which is a 35 U.S.C. §371 of International Application No. PCT/JP02/011118 filed Oct. 25, 2002, which claims priority to Japanese Patent Application. No. 2001-331265 filed Oct. 29, 2001, which is incorporated by reference herein in its entirety.

TECHNICAL FIELD

The present invention relates to a steel sheet for vitreous enameling excellent in enameling properties (bubbling and black spot resistance, enamel adhesiveness and fish scale resistance) and workability, and a method for producing the steel sheet.

BACKGROUND ART

A steel sheet for vitreous enameling was conventionally produced by subjecting a capped steel or a rimmed steel to ingot casting, break down rolling, hot rolling, cold rolling, and then, open coil annealing for decarbonization and further denitrification annealing for lowering the contents of carbon and nitrogen to several tens of ppm or less. However, a steel sheet for vitreous enameling produced through these processes had the following shortcomings: the steel sheet was manufactured through the ingot casting and break down rolling processes; the annealing processes for decarbonization and denitrification were required; and, as a consequence, the cost of manufacturing was high.

In this background, technologies of producing a steel sheet for vitreous enameling by employing continuous casting were developed aiming at overcoming the shortcomings. At present, it is a common practice to produce a steel sheet for vitreous enameling by the continuous casting method for reducing the manufacturing cost. As an example of such technologies, Japanese Unexamined Patent Publication No. H07-166295 discloses a technology of producing a steel sheet for vitreous enameling by subjecting a high-oxygen steel to continuous casting. However, a steel sheet for vitreous enameling produced by the technology is inferior in enameling properties and is not applicable to deep-drawn products having complicated shapes.

The finding that an addition of Nb and V makes it possible to produce a steel sheet for vitreous enameling having good workability and enameling properties has been disclosed in Japanese Unexamined Patent Publication No. H1-275736. This is an epoch-making technology in which Nb and V are added as elements capable of maintaining a high oxygen content in a steel, thanks to their low deoxidation capacity, and create good workability by fixing C and N in the steel in the form of carbide and nitride. Besides this, although it is not related to the enameling properties and workability, Japanese Patent No. 2040437 regarding a steel sheet for vitreous enameling containing Nb and V, wherein the swelling likely to peculiarly take place during casting under special conditions is prevented by adding Sn, has been disclosed.

In addition, as a result of efforts to improve a steel sheet for vitreous enameling containing Nb and V and being excellent in fish scale resistance and deep drawability, the present inventors filed Japanese Patent Application No. 2000-390332. However, although a steel sheet according to the proposed technology secures a high and stable r-value, it is not sufficient to attain fish scale resistance as good as or better than that of a purely Al-free, high-oxygen steel simultaneously with a good r-value. It is known that, for suppressing fish scales of a steel sheet for vitreous enameling, it is effective to form voids in a steel sheet and trap hydrogen which has penetrated into the steel sheet in the voids during the baking of vitreous enamel. However, the mere formation of voids does not necessarily increase the capacity to trap hydrogen. The influence of a steel chemical composition on vitreous enameling properties has been pointed out in various technologies, and various technologies of prescribing a steel chemical composition especially for improving fish scale resistance have been disclosed.

It is publicly known that the addition of Nb and V makes it possible to produce a steel sheet for vitreous enameling having good workability and enameling properties, for instance, through above-mentioned Japanese Unexamined Patent Publication No. H1-275736 and Japanese Patent No. 2040437. While these technologies may be interpreted, from the viewpoint of fish scale resistance, as those proposing the formation of voids and the improvement of the hydrogen trapping capacity of the voids, it is hard to say that the optimum control from the viewpoint of the volume, shape and nature of the voids is employed in the technologies. As a result, the technologies are insufficient to improve fish scale resistance and the application thereof to practical use is hindered.

DISCLOSURE OF THE INVENTION

The object of the present invention is overcoming the above-mentioned problems of a conventional steel sheet for vitreous enameling, providing a non-aging steel sheet for vitreous enameling produced through continuous casting which is excellent in fish scale resistance in one-coat enameling and providing a method for producing the steel sheet. The present invention makes it possible to obtain a steel sheet having a higher figure of r-value, which is an indicator of deep drawability, when the steel sheet contains Nb and V, than that of a conventional steel sheet.

The present invention has been established as a result of various studies aiming at overcoming the shortcomings of the conventional steel sheets and the production methods thereof. The findings A) to E) described below have been obtained as a result of examining the influences of production conditions on the workability and enameling properties of a steel sheet for vitreous enameling, using the steels having the chemical compositions specified below as examples.

Chemical Composition:

C: 0.0005 to 0.010%,
Mn: 0.02 to 1.5%,
O: 0.015 to 0.07%,
Nb: 0.002 to 0.1%,
V: 0.002 to 0.1%,
Cu: 0.08% or less,
Si: 0.05% or less,
P: 0.005 to 0.045%,
S: 0.12% or less,
Al: below 0.03%, and
N: 0.001 to 0.0065%.

Production Conditions:

Reheating temperature: 1,250 to 1,050° C.,
Finishing temperature: 750 to 950° C., Coiling temperature: 500 to 800° C.,
Cold reduction ratio: 50% or more, and
Annealing: at 650 to 850° C. for 1 to 300 min.

Enameling Properties:

Fish scale resistance, surface defects relating to bubbling and black spots, and enamel adhesiveness were examined after subjecting a steel sheet to pickling, Ni treatment, and then one-coat enameling treatment to form an enamel film 100 μm in thickness. The findings obtained as a result are as follows:

A) The lower the amounts of C and oxygen are, the better the deep drawability is.

B) The deep drawability is improved and the aging is lowered when Mn of a prescribed amount or more is added to a steel having a comparatively high S content.

C) With respect to the deep drawability, a high r-value is obtained when Nb at 0.004% or more is added to a steel containing C at 0.0025% or less.

D) An aging index of 5 MPa or less is obtained regardless of annealing conditions when the following conditions of the component elements are satisfied; C: 0.0025% or less, V: 0.003% or more and Nb: 0.004% or more.

E) The hydrogen permeation time, which has a good correlation with fish scale resistance, is influenced by the contents of oxygen, Mn, S, V and Nb, and, the larger the addition amounts of these elements are, the longer the hydrogen permeation time is.

The gist of the present invention, which has been established based on the above facts, is as follows.

(1) A steel sheet for vitreous enameling excellent in workability and fish scale resistance, characterized in that: the steel sheet contains, in mass,
C: 0.010% or less,
Mn: 0.03 to 1.3%,
Si: 0.03% or less,
Al: 0.02% or less,
N: 0.0055% or less,
P: below 0.035%, and
S: over 0.025% to 0.08%; and
the density change of the steel sheet from before an annealing to after an annealing at 850° C. for 20 h. in a hydrogen atmosphere is 0.02% or more.

(2) A steel sheet for vitreous enameling excellent in workability and fish scale resistance according to the item (1), characterized by: containing, in mass,
C: 0.010% or less,
Mn: 0.03 to 1.3%,
Si: 0.03% or less,
Al: 0.02% or less,
N: 0.0055% or less,
P: below 0.035%, and
S: over 0.025% to 0.08%; and
having voids 0.10 μm or more in size among oxide grains.

(3) A steel sheet for vitreous enameling excellent in workability and fish scale resistance according to the item (1) or (2), characterized by containing, in mass,
C: 0.0025% or less,
Mn: 0.05 to 0.8%,
Si: 0.015% or less,
Al: below 0.015%,
N: 0.0045% or less,
O: 0.005 to 0.055%,
P: below 0.025%,
S: over 0.025% to 0.08%,
Cu: 0.02 to 0.045%,
Nb: over 0.004% to 0.06%, and
V: 0.003 to 0.06%,
with the balance consisting of Fe and unavoidable impurities.

(4) A steel sheet for vitreous enameling excellent in workability and fish scale resistance according to the item (3), characterized by further containing one or more of As, Ti, B, Ni, Se, Cr, Ta, W, Mo, Sn and Sb at 0.02 mass % or less in total.

(5) A method for producing a steel sheet for vitreous enameling excellent in workability and fish scale resistance, characterized by, in the hot rolling in the temperature range of 600° C. or higher of a steel containing, in mass,
C: 0.010% or less,
Mn: 0.03 to 1.3%,
Si: 0.03% or less,
Al: 0.02% or less,
N: 0.0055% or less,
P: below 0.035%, and
S: over 0.025% to 0.08%:
hot rolling the steel so that the total true strain is 0.4 or more under the conditions that the temperature is 1,000° C. or higher and the strain rate is 1/sec. or more; and thereafter, hot rolling the steel so that the total true strain is 0.7 or more under the conditions that the temperature is 1,000° C. or lower and the strain rate is 10/sec. or more.

BEST MODE FOR CARRYING OUT THE INVENTION

Figure 1:
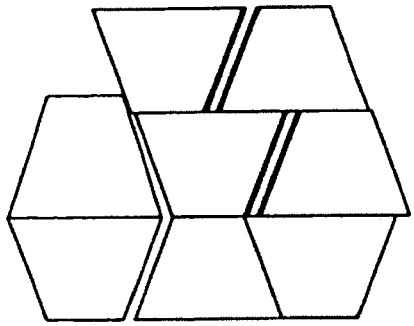
FIG. 1. shows the activated inner surfaces of the steel before annealing at 850° C. for 20 hours.

The present invention is described in detail hereafter.

In the first place, the chemical composition of a steel is explained in detail.

It has been known from the past that the lower the amount of C in steel is, the better the workability is. Accordingly, in the present invention, the content of C is determined to be 0.010% or less. Further, in order to suppress aging and obtain a higher r-value than that of a conventional steel not containing Nb or V (which has an r-value of 1.7 or so) by adding Nb and V, it is desirable that the content of C is controlled to 0.0025% or less. A more preferable C content is 0.0015% or less. Although it is not necessary to specify the lower limit of the C content, it is desirable that the C content is 0.0005% or more, as a further reduction of the C content increases the cost in steelmaking.

The content of Si is determined to be 0.03% or less, because Si tends to deteriorate enameling properties. It is desirable, for the same reason, to control the Si content to 0.015% or less. A yet preferable Si content range is 0.008% or less for realizing good enameling properties.

Mn is an important component which influences enameling properties in combination with the addition amounts of oxygen, V and Nb. Mn is also an element to prevent hot shortness caused by S during hot rolling, and Mn content is determined to be 0.03% or more in a steel containing oxygen according to the present invention. A preferable Mn content is 0.05% or more. Generally speaking, when the content of Mn is high, enamel adhesiveness is adversely affected and bubbles and black spots are likely to occur, but, in a steel according to the present invention, which is desired to have a higher S content than a conventional steel, the adverse effects caused by the addition of Mn are not significant. Rather, fish scale resistance is improved by an increase of the Mn content and, for this reason, Mn is added actively. For the above reasons, the upper limit of the Mn content is set at 1.3%. A preferable upper limit of the Mn content is 0.8% and, more preferably, 0.6%.

Oxygen has a direct influence on fish scale resistance and workability. It also affects enamel adhesiveness, bubbling and black spot resistance and fish scale resistance in combination with the contents of Mn, Nb and V. For these reasons, it is desirable to contain oxygen in a steel. It is desirable that the oxygen content is 0.005% or more for demonstrating these effects. When its content is high, however, the high oxygen content directly deteriorates workability and, besides, tends to decrease the efficiency of the addition of Nb and V, and, by so doing, indirectly deteriorate workability and an aging property. For these reasons, it is desirable to set the upper limit of oxygen content at 0.055%.

Al is a deoxidizing element and, for improving fish scale resistance, which is an index of enameling properties, it is desirable to retain an adequate amount of oxygen in a steel in the form of oxide. For this end, the Al content is determined to be below 0.02%. A desirable Al content is below 0.015%.

N is an interstitial solid solution element like C. When its content exceeds 0.0045%, workability tends to deteriorate even with an addition of Nb and V, and it becomes difficult to produce a non-aging steel sheet. For this reason, the upper limit of the N content is set at 0.0055%. A preferable content of N is 0.045% (should be 0.0045%?) or less. Although it is not necessary to specify the lower limit of the N content, a desirable lower limit is 0.001%, since the reduction of the N content to 0.001% or less is costly with the current steelmaking technologies.

When the content of P is high, the pickling rate at a pre-treatment process for enameling is accelerated and, as a result, smuts, which cause bubbles and black spots, are increased. For this reason, the P content is limited to below 0.035% in the present invention. A preferable P content is below 0.01%.

It is especially desirable in the present invention to make the content of S higher than that of a conventional steel sheet, and its content range is determined to be from 0.025 to 0.08%. S exists predominantly in the form of sulfide of Mn and Cu in a steel. Therefore, when the content of S is changed, the shape and amount of the sulfide of Mn and Cu change as a consequence. In the meantime, Mn exists also in the form of oxide in a steel. In particular, in a steel containing Nb and V, which is considered especially desirable in the present invention, Mn exists in the form of Nb—V—Mn—Si—Fe compound oxide and, as a consequence, the change in the content of Mn, which works effectively in the form of oxide, exerts a more complicated influence than in the case where Mn exists in the form of simple Mn oxide. That is, when Mn exists in the form of simple Mn oxide, a change in the content of Mn causes mainly a change in the amount of the oxide directly, and the change in the shape such as the size of the oxide grains is comparatively small. On the other hand, when Mn exists in the form of the compound oxide with Nb and other elements, even in the case where the content of Mn changes, for instance, if it decreases, an action of suppressing the change of the amount of the oxide sometimes works caused by the change of the composition of the oxide towards high-Nb oxide. At the same time, it is also considered that, when the high-Nb oxide is unstable, the decrease of the amount of oxide is larger than that of the amount of Mn, depending on conditions. Further, whereas, when Mn exists in the form of simple oxide, the composition of the oxide is more or less constant in the form of Mn oxide, when Mn exists in the form of compound oxide, for example, taking into consideration of Mn and Nb, the ratio between Mn and Nb widely varies from Mn—O to Nb—O and the composition varies more widely. A difference in the composition of oxide means the difference in the properties of the oxide such as hardness and ductility, and that significantly influences the states of the elongation and fracture of the oxide in hot rolling and cold rolling.

In the case where many kinds of elements such as Nb, V, Mn, Si and Fe are included in an oxide grain, the situation is more complicated and therefore it becomes very important to control the contents of the elements in the oxide grain for improving the properties of a steel sheet, as a matter of course, depending on their contents in the steel and the production conditions. Besides, when the content of S is increased, the amount of solute Mn is decreased. As a consequence, in that case, even when the amount of Mn is increased, the deterioration of bubbling and black spot resistance is lowered, and the effect of generating cementite by using MnS grains as nuclei becomes appreciable and, by so doing, the aging caused by solute C is also decreased. As these effects are seen not in a conventional steel but only in a steel containing oxide-forming elements such as Nb and V together with Mn, it is supposed that the effects are related to MnS, the precipitation of which is accelerated by using the oxide grains containing Mn, Nb, V and so on as the precipitation nuclei.

V is a component desirable to be added in the present invention. When added, V fixes C and N and, thus, prevents the deterioration of deep drawability caused by N and the deterioration of press formability resulting from the decrease in elongation caused by aging. A part of V added to a steel combines with oxygen in the steel to form oxide and, by so doing, plays an effective role in preventing fish scales from occurring. It also has an indirect effect of improving workability by lowering the amount of oxygen required for suppressing the occurrence of fish scales. For these reasons, it is desirable to set the lower limit of the V content at 0.003%. On the other hand, when the addition amount of V is increased, enamel adhesiveness and bubbling and black spot resistance are deteriorated and, therefore, it is desirable to set its upper limit at 0.06%, if it is added.

Nb is another element desirable to be added in the present invention. Nb fixes C and N and, thus, improves deep drawability and renders a steel sheet non-aging. Nb added to a steel also combines with oxygen in the steel to form oxide and, by so doing, plays an effective role in preventing fish scales from occurring. It also has an indirect effect of improving workability by lowering the amount of oxygen required for suppressing the occurrence of fish scales. For these reasons, it is desirable that the content of Nb is over 0.004%, if it is added. However, when the addition amount of Nb is increased, enamel adhesiveness and bubbling and black spot resistance are deteriorated and, for this reason, it is desirable to set the upper limit of the Nb content at 0.06%, if it is added.

Cu is well known to have the function of suppressing the pickling rate at a pre-treatment for enameling. In the present invention, Cu is required to be added to at least 0.02% in order for Cu to demonstrate the above effect, if it is added. However, since a steel according to the present invention contains extremely small amounts of solute C and N because of the addition of Nb and V, when the effect of suppressing the pickling rate is too strong, enamel adhesiveness is deteriorated in the range where the pickling time is short. For this reason, it is desirable to set the upper limit of the Cu content to 0.045%, if it is added.

It is desirable to lower the contents of the other unavoidable impurities, because they have adverse effects on material properties and enameling properties. As far as the total content of one or more of As, Ti, B, Se, Ta, W, Mo, Sn, Sb, La, Ce, Ca and Mg is 0.08% or less and the total content of Cr and/or Ni is 25% or less, the effects of the present invention are not hindered significantly. In other words, as far as their total contents do not exceed the above limits, respectively, they may be added actively in pursuit of the advantages in production or quality, besides the advantages envisaged in the present invention.

Figure 2:
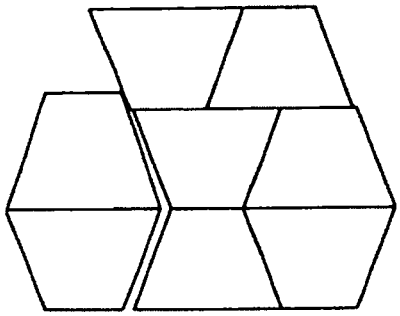
FIG. 2 shows the activated inner surfaces of the steel after annealing at 850° C. for 20 hours.
Figure 3:
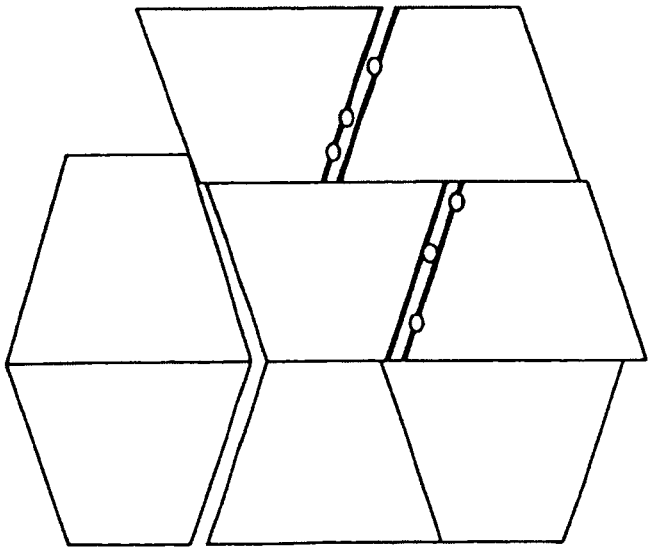
FIG. 3 shows a state which hydrogen is trapped at voids of the activated inner surfaces.

The present invention is characterized by controlling the change in the density of a steel when it is retained at a high temperature for a long time. Here, the change in density is considered to be an indicator expressing the activity of the inner surfaces of voids in a steel, which is one of the characteristics required of a steel according to the present invention. Specifically, in order to obtain good fish scale resistance, it is necessary that the density change of a steel sheet from before annealing to after an annealing at 850° C. for 20 h. in a hydrogen atmosphere is 0.02% or more. The reason for this is not clear, but it is supposed that, to have the voids work effectively as the sites of hydrogen trapping, the state of their inner surfaces, as well as their shape and volume, is significant. In other words, it is presumed that such voids existing in the inner surfaces easily disappear during a retaintion at a high temperature, namely such voids largely affect to the change in the density of a steel sheet during a retention at a high temperature, are in an activated state, that the activated inner surfaces are strongly inclined to react with Fe or oxide-forming elements supplied through diffusion at a high temperature of 850° C. for 20 hours and, by so doing, annihilate themselves, and that, at the same time, the activated inner surfaces are in the state of having a high hydrogen trapping capacity by readily reacting with hydrogen penetrating into the steel during cooling step after firing and cooling step at a room temperature and adsorbing it. FIGS. 1 to 3 schematically show the situations explained above. FIG. 1. shows the activated inner surfaces of the steel before annealing at 850° C. for 20 hrs. Bold lines represent the activated inner surfaces. FIG. 2. shows the activated inner surfaces of the steel after annealing at 850° C. for 20 hours, and also shows no activated inner surfaces is found. Further, FIG. 3. shows a state which hydrogen is trapped at voids of the activated inner surfaces. In FIG. 3. small spots represents hydrogen.

Further, it becomes possible to obtain better properties by specifying the size of voids in a steel. Specifically, it is necessary that voids 0.10 μm or more in size exist among the crushed and dispersed oxide particles. The reason for this is not clear, but it is supposed that, to have the voids work effectively as the hydrogen trapping sites, the state of stress in the vicinity of the voids, as well as their shape and volume, is significant. In other words, it is presumed that, when voids are small in size, the stress fields formed around the voids are small and, as a consequence, the voids cannot efficiently trap hydrogen passing near them by diffusion, but that, when voids are large enough to form large stress fields, the voids trap hydrogen efficiently from a wider area thanks to the large stress gradient. Here, when the total volume of voids is constant, it is more advantageous to disperse a great number of fine voids from the viewpoint of increasing the area of the inner surfaces of the voids involved in the hydrogen trapping. Further, when the total volume of voids is constant, if the size of each void is too large and the density of the number of the voids is too low, the efficiency of hydrogen trapping is lowered. From this standpoint, it is desirable that the size of a void is 0.80 μm or less though it depends on the total volume of the voids.

Next, the production method is described hereafter. Though a steel slab according to the present invention is produced by continuous casting, the advantages of the present invention are not adversely affected even when a steel slab is produced by an ingot casting and break down rolling method. A cast slab is subsequently hot rolled, and a commonly practiced reheating temperature range of 1,050 to 1,250° C. is applicable, since the temperature of the reheating does not affect the advantages of the present invention. Any finishing temperature in hot rolling is acceptable as long as it is 800° C. or higher, but, in consideration of the operability of hot rolling, it is desirable that the finishing temperature is a temperature equal to or higher than the $Ar_3$ transformation temperature of a steel.

Figure 4:
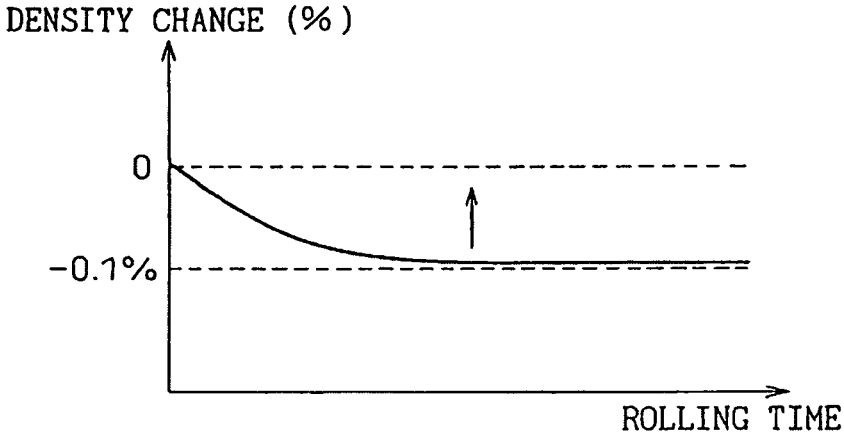
FIG. 4. shows a relationship between a rolling time and density change.

Note that, to obtain a good fish scale resistance, it is effective, in the hot rolling of a steel in the temperature range of 600° C. or higher: to hot roll the steel so that the total true strain is 0.4 or more under the conditions that the temperature is 1,000° C. or higher and the strain rate is 1/sec. or more; and thereafter, to hot roll the steel so that the total true strain is 0.7 or more under the conditions that the temperature is 1,000° C. or lower and the strain rate is 10/sec. or more. FIG. 4 shows a relationship between a rolling time and density change. It is understand that voids develop among the crashed and disposed oxides as rolling. This is presumably because a desirable shape and suitable properties of voids, especially the activity of the inner surfaces thereof, are obtained by controlling the process of forming the voids existing in said steel. Though how the above is realized is not clear, the mechanism by which the effect of the present invention appears is explained hereafter by including some assumptions. While voids are formed mainly by the fragmentation of oxide grains during cold rolling subsequent to hot rolling, it is important to control the shape of the oxide grains beforehand during hot rolling. That is, oxide grains are softened because the temperature in a hot rolling process is high, and their hardness is not much different from that of the base metal, which constitutes a parent phase, and, for this reason, in a temperature range around 1,000° C. or above, the fragmentation of oxide grains is hardly generated and the oxide grains are elongated. When a temperature falls to lower than 1,000° C., namely about 900° C. or lower, while the oxide grains hardly become elongated, a distinct fragmentation as seen in the case of cold rolling is not generated, but fracture occurs only partially to an extent of generating fine cracks. In order to obtain oxide grains elongated to an adequate extent and simultaneously having fine cracks before cold rolling, important are the control of temperatures at hot rolling, the control of the amount of strain in different temperature ranges, and the control of the strain rate in view of the fact that the recovery of the deformed base metal and oxide grains occurs conspicuously because they are subjected to working while they are hot.

When the temperature range of hot working is too high, the recovery is violent and it is impossible to impose an amount of strain sufficient to form cracks in the oxide grains. When the temperature range is too low, on the other hand, the shape of oxide grains does not become an elongated one but does become a nearly spherical one, and it becomes difficult to form cracks in them. Thus, it is necessary for oxide grains to have a suitably elongated and thin shape in order to form cracks. To do so, it is necessary to, during hot rolling, elongate oxide grains by giving an adequate deformation in a comparatively high temperature range and, then, form cracks in them in a controlled manner in a comparatively low temperature range.

Then, by fragmenting such elongated oxide grains having fine cracks in cold rolling, it becomes possible to generate voids having desired new surfaces, namely activated inner surfaces, and thus trap hydrogen effectively. Though the reason why the fracture surfaces originating from cracks is more activated in trapping hydrogen than the fracture surfaces not originating from cracks is not clear, it is supposed as a cause that some sorts of elements diffuse and precipitate in the cracks after the formation of the cracks, mainly during the high temperature retention in the coiling process of hot rolling.

In cold rolling, a cold reduction ratio of 60% or more is required in order to obtain a steel sheet having good deep drawability. When better deep drawability is required in particular, it is preferable to apply a cold reduction ratio of 75% or more.

As for annealing, the advantages of the present invention are not affected by whether box annealing or continuous annealing is employed, and the advantages thereof can be enjoyed as far as a temperature equal to or higher than the recrystallization temperature of a steel to be heat-treated is attained. Continuous annealing is preferable especially for realizing excellent deep drawability and good enameling properties, which are the advantages of the present invention. As a steel according to the present invention is characterized in that the recrystallization is completed at 650° C. even when the annealing time is short, a particularly high temperature is not required. A generally suitable temperature range is from 650 to 750° C. for box annealing and from 700 to 800° C. for continuous annealing.

As explained above, a steel sheet having a chemical composition according to the present invention or that produced under the production conditions according to the present invention is a steel sheet for vitreous enameling: having press formability as good as or superior to that of a conventional decarbonized capped steel; being not prone to cause the defects of bubbles and black spots even in direct one-coat enameling; and being excellent in enamel adhesiveness, even when it is produced from a continuously cast slab. Further, also in an application to a bathtub or a kettle, which is other than the case of direct one-coat enameling, a steel sheet according to the present invention exhibits the advantages of the present invention, similar to the case of the direct one-coat enameling.

EXAMPLE

Continuously cast slabs having various chemical compositions were subjected to hot rolling, cold rolling and annealing under various production conditions. In succession, the cold-rolled and annealed steel sheets thus produced underwent skin pass rolling at a reduction ratio of 1.0%, and then the mechanical properties and enameling properties of the steel sheets thus produced were examined. The chemical compositions, production conditions and examination results are shown in Table 1.

The mechanical properties were examined in terms of tensile strength, r-value and aging index (AI), using the JIS No. 5 test pieces formed out of the steel sheets. An aging index was expressed by the difference of the stresses before and after a test piece was aged at 200° C. for 20 min. after being subjected to a pre-strain of 10%.

Enameling properties were evaluated after the process steps shown in Table 2. Among the enameling properties, the surface properties on bubbling and black spots were evaluated under the condition of a long pickling time of 25 min. and the evaluation results were given as follows: ◎ no occurrence of bubbles and black spots, ○ limited occurrence, and x large occurrence.

Enamel adhesiveness was evaluated under the condition of a short pickling time of 2 min. Because the commonly employed P.E.I. adhesiveness test method (ASTM C313-59) was incapable of detecting small difference in the enamel adhesiveness, enamel adhesiveness was evaluated by dropping a 2.0-kg weight with a spherical head on a test piece from a height of 1 m, measuring the exfoliation state of the enameling film at the deformed area using 169 probing needles, and calculating the percentage of the non-exfoliated area.

Fish scale resistance was evaluated by the accelerated fish scale test, wherein three steel sheets were pre-treated through 2-min. pickling without Ni immersion, glazed with a glaze for direct one-coat enameling, dried, baked for 3 min. in a baking furnace kept at 850° C. and having a dew point of 50° C., and then held for 10 h. in a constant temperature tank kept at 160° C. The occurrence or otherwise of fish scales was visually judged and the results were indicated as follows: ◎ no occurrence of fish scales, ○ limited occurrence, and x large occurrence.

As is clear from the results shown in Table 1, the steel sheets according to the present invention are the steel sheets for vitreous enameling excellent in r-value, El, aging resistance and enameling properties. The steels according to the present invention have a good aging property (AI: 0) thanks to the addition of Nb and V. On the other hand, the steel sheets shown as comparative examples are inferior in material properties and/or enameling properties. The steels according to the present invention have, in addition to the above, a feature of the in-plane anisotropy of r-value being very low, which is considered advantageous from the viewpoint of formability and the yield of steel sheets at forming. This means that a steel sheet excellent in material properties and enameling properties cannot be produced unless the chemical composition and the close relationship among component elements are controlled within the ranges specified in the present invention.

TABLE 1

| Chemical components (wt %) | | | | | | | | | | | | |
|---|---|---|---|---|---|---|---|---|---|---|---|---|
| C | Si | Mn | P | S | Al | N | V | Nb | O | Cu | Other elements | |
| 0.0014 | 0.008 | 0.28 | 0.007 | 0.054 | 0.0095 | 0.0028 | 0.049 | 0.054 | 0.015 | 0.042 | | Invented example |
| 0.0014 | 0.008 | 0.28 | 0.007 | 0.054 | 0.0095 | 0.0028 | 0.049 | 0.054 | 0.015 | 0.042 | | Invented example |
| 0.0014 | 0.008 | 0.28 | 0.007 | 0.054 | 0.0095 | 0.0028 | 0.049 | 0.054 | 0.015 | 0.042 | | Invented example |
| 0.0008 | 0.010 | 0.23 | 0.006 | 0.045 | 0.0031 | 0.0006 | 0.039 | 0.052 | 0.031 | 0.032 | | Invented example |

TABLE 1-continued

| | | | | | | | | | | | | |
|---|---|---|---|---|---|---|---|---|---|---|---|---|
| 0.0008 | 0.010 | 0.23 | 0.006 | 0.045 | 0.0031 | 0.0006 | 0.039 | 0.052 | 0.031 | 0.032 | | Invented example |
| 0.0008 | 0.010 | 0.23 | 0.006 | 0.045 | 0.0031 | 0.0006 | 0.039 | 0.052 | 0.031 | 0.032 | | Invented example |
| 0.0012 | 0.002 | 0.51 | 0.011 | 0.057 | 0.0008 | 0.0016 | 0.037 | 0.058 | 0.049 | 0.043 | | Invented example |
| 0.0012 | 0.002 | 0.51 | 0.011 | 0.057 | 0.0008 | 0.0016 | 0.037 | 0.058 | 0.049 | 0.043 | | Invented example |
| 0.0012 | 0.002 | 0.51 | 0.011 | 0.057 | 0.0008 | 0.0016 | 0.037 | 0.058 | 0.049 | 0.043 | | Invented example |
| 0.0018 | 0.008 | 0.07 | 0.006 | 0.038 | 0.0045 | 0.0031 | 0.049 | 0.040 | 0.047 | 0.016 | Cr: 0.53<br>Ni: 0.05 | Invented example |
| 0.0021 | 0.007 | 0.22 | 0.010 | 0.045 | 0.0062 | 0.0020 | 0.047 | 0.042 | 0.026 | 0.036 | Sn: 0.008<br>Ca: 0.005<br>Mg: 0.003 | Invented example |
| 0.0009 | 0.003 | 0.28 | 0.012 | 0.055 | 0.0023 | 0.0015 | 0.045 | 0.036 | 0.017 | 0.028 | B: 0.0015 | Invented example |
| 0.0043 | 0.002 | 0.55 | 0.006 | 0.065 | 0.0075 | 0.0037 | 0.046 | 0.039 | 0.027 | 0.038 | | Comparative example |
| 0.0022 | 0.011 | 0.20 | 0.008 | 0.040 | 0.0210 | 0.0009 | 0.049 | 0.032 | 0.003 | 0.035 | | Comparative example |
| 0.0022 | 0.011 | 0.20 | 0.008 | 0.040 | 0.0210 | 0.0009 | 0.049 | 0.032 | 0.003 | 0.035 | | Comparative example |
| 0.0013 | 0.080 | 0.12 | 0.008 | 0.011 | 0.0035 | 0.0024 | 0.035 | 0.035 | 0.027 | 0.033 | | Comparative example |
| 0.0013 | 0.080 | 0.12 | 0.008 | 0.011 | 0.0035 | 0.0024 | 0.035 | 0.035 | 0.027 | 0.033 | | Comparative example |
| 0.0016 | 0.008 | 0.22 | 0.006 | 0.007 | 0.0102 | 0.0023 | 0.040 | 0.038 | 0.025 | 0.035 | | Comparative example |
| 0.0016 | 0.008 | 0.22 | 0.006 | 0.007 | 0.0102 | 0.0023 | 0.040 | 0.038 | 0.025 | 0.035 | | Comparative example |
| 0.0016 | 0.008 | 0.22 | 0.006 | 0.007 | 0.0102 | 0.0023 | 0.040 | 0.038 | 0.025 | 0.035 | | Comparative example<br>Comparative example |

| Hot rolling | | | | | Cold | | | | | Density | | Enameling properties | | | |
|---|---|---|---|---|---|---|---|---|---|---|---|---|---|---|---|
| Slab reheating temperature (° C.) | Rolling work A | Rolling work B | Finishing temperature (° C.) | Coiling temperature (° C.) | rolling Reduction ratio (%) | Annealing Temperature (° C.) | Annealing Time (min.) | Mechanical properties r-value | Mechanical properties Aging index | change before/after annealing (%) | Void among oxide grains (μm) | Bubbling and black spot resistance | Enamel adhesiveness | Fish scale resistance | |
| 1200 | 0.3 | 0.5 | 870 | 600 | 82 | 850 | 1 | 2.35 | 0 | 0.12 | 0.08 | ○ | ○ | ○ | Invented example |
| 1150 | 0.8 | 0.5 | 890 | 600 | 82 | 850 | 1 | 2.38 | 0 | 0.15 | 0.13 | ○ | ○ | ○ | Invented example |
| 1150 | 1.2 | 1.5 | 880 | 710 | 82 | 860 | 1 | 2.45 | 0 | 0.22 | 0.12 | ○ | ○ | ◎ | Invented example |
| 1150 | 0.3 | 0.6 | 920 | 710 | 76 | 830 | 1 | 2.23 | 0 | 0.08 | 0.06 | ○ | ○ | ○ | Invented example |
| 1100 | 1.0 | 1.3 | 900 | 730 | 76 | 860 | 1 | 2.30 | 0 | 0.18 | 0.21 | ○ | ○ | ◎ | Invented example |
| 1100 | 1.5 | 2.3 | 880 | 710 | 76 | 840 | 1 | 2.30 | 0 | 0.24 | 0.18 | ○ | ○ | ◎ | Invented example |
| 1100 | 0.3 | 0.5 | 880 | 550 | 84 | 785 | 1 | 2.16 | 0 | 0.05 | 0.05 | ○ | ○ | ○ | Invented example |
| 1100 | 0.3 | 1.3 | 880 | 750 | 84 | 785 | 1 | 2.14 | 0 | 0.09 | 0.04 | ○ | ○ | ○ | Invented example |
| 1100 | 2.2 | 1.3 | 890 | 710 | 84 | 785 | 1 | 2.22 | 0 | 0.18 | 0.11 | ○ | ○ | ◎ | Invented example |
| 1100 | 1.3 | 2.5 | 900 | 550 | 75 | 790 | 1 | 1.95 | 0 | 0.15 | 0.23 | ○ | ○ | ◎ | Invented example |
| 1100 | 1.8 | 2.0 | 900 | 720 | 80 | 775 | 1 | 2.06 | 0 | 0.22 | 0.12 | ○ | ○ | ◎ | Invented example |
| 1100 | 2.3 | 1.5 | 890 | 730 | 70 | 810 | 1 | 2.31 | 0 | 0.20 | 0.10 | ○ | ○ | ◎ | Invented example |
| 1100 | 1.5 | 2.3 | 890 | 720 | 77 | 800 | 1 | 1.98 | 30 | 0.14 | 0.12 | ○ | ○ | ○ | Comparative example |
| 1150 | 0.3 | 0.5 | 900 | 720 | 77 | 840 | 1 | 2.35 | 0 | 0.00 | 0.01 | ○ | ○ | X | Comparative example |
| 1150 | 1.5 | 2.3 | 890 | 720 | 77 | 840 | 1 | 2.35 | 0 | 0.00 | 0.00 | ○ | ○ | X | Comparative example |
| 1150 | 1.0 | 0.6 | 910 | 720 | 77 | 830 | 1 | 2.38 | 0 | 0.01 | 0.03 | ○ | ○ | X | Comparative example |

TABLE 1-continued

| | | | | | | | | | | | | | | | |
|---|---|---|---|---|---|---|---|---|---|---|---|---|---|---|---|
| 1150 | 2.2 | 1.3 | 910 | 720 | 77 | 830 | 1 | 2.38 | 0 | 0.01 | 0.01 | ○ | ○ | X | Comparative example |
| 1100 | 0.3 | 0.6 | 890 | 720 | 78 | 800 | 1 | 2.20 | 0 | 0.01 | 0.18 | ○ | ○ | Δ | Comparative example |
| 1100 | 1.0 | 1.3 | 890 | 720 | 78 | 800 | 1 | 2.16 | 0 | 0.02 | 0.24 | ○ | ○ | Δ | Comparative example |
| 1100 | 1.5 | 2.3 | 890 | 720 | 78 | 800 | 1 | 2.25 | 0 | 0.01 | 0.19 | ○ | ○ | Δ | Comparative example Comparative example |

A: Total true strain imposed under the conditions that the temperature is 1,000° C. or higher and the strain rate is 1/sec. or more.
B: Total true strain imposed under the conditions that the temperature is 1,000° C. or lower and the strain rate is 10/sec. or more.

TABLE 2

| | Process step | Condition |
|---|---|---|
| 1 | Degreasing | Alkaline degreasing |
| 2 | Hot water rinse | |
| 3 | Water rinse | |
| 4 | Pickling | 15% $H_2SO_4$, 75° C. × 3 or 20 min. immersion |
| 5 | Water rinse | |
| 6 | Ni treatment | 2% $NiSO_4$, 70° C. × 3 min. immersion |
| 7 | Water rinse | |
| 8 | Neutralization | 2.0% $Na_2CO_3$, 75° C. × 5 min. immersion |
| 9 | Drying | |
| 10 | Glazing | Direct one-coat glaze, 100 μm in thickness |
| 11 | Drying | 160° C. × 10 min. |
| 12 | Baking | 840° C. × 3 min. |

A steel sheet for vitreous enameling according to the present invention has deep drawability as good as or superior to that of a conventionally used Ti-containing steel having good press formability, and satisfies all the requirements of a steel sheet for vitreous enameling, namely fish scale resistance, bubbling and black spot resistance, enamel adhesiveness and surface properties. In addition, the present invention largely decreases the costs of annealing, because it makes it viable to produce a steel sheet excellent in press formability and aging resistance through either continuous annealing or box annealing, in place of the decarbonization annealing or decarbonization and denitrification annealing which are applied to a conventional high-oxygen steel produced through continuous casting. Thus, the present invention has a great industrial significance.

The invention claimed is:

1. A method for producing a steel sheet for vitreous enameling, the method comprising the steps of hot rolling a steel sheet consisting essentially of, in mass, C: 0.0025% or less,
Mn: 0.03 to 1.3%,
Si: 0.03% or less,
Al: 0.02% or less,
N: 0.0055% or less,
P: below 0.035%,
S: over 0.025% to 0.08%,
Cu:
0.02% to 0.045%,
Nb: 0.036% to 0.06%, and
V: 0.003 to 0.06%,
and the balance of Fe and unavoidable impurities, in a temperature range of 600° C. or higher so that a total true strain is 0.4 or more under conditions that a temperature is 1,000° C. or higher and a strain rate is 1/sec. or more; and thereafter, hot rolling the steel sheet so that the total true strain is 0.7 or more under conditions that a temperature is 1,000° C. or lower and a strain rate is 10/sec. or more, wherein said steel sheet has voids of 0.10 μm or more in size among oxide grains and said voids are dispersed in the interior of the steel sheet.

2. A method for producing a steel sheet for vitreous enameling, the method comprising the steps of hot rolling a steel sheet consisting essentially of, in mass, C: 0.0025% or less,
Mn: 0.03 to 1.3%,
Si: 0.03% or less,
Al: 0.02% or less,
N: 0.0055% or less,
P: below 0.035%,
S: over 0.025% to 0.08%,
Cu: 0.02% to 0.045%,
Nb: 0.036% to 0.06%,
V: 0.003 to 0.06%,
one or more of: As, Ti, B, Ni, Se, Cr, Ta, Sn and Sb at 0.02 mass% or less in total,
and the balance of Fe and unavoidable impurities, in a temperature range of 600° C. or higher so that a total true strain is 0.4 or more under conditions that a temperature is 1,000° C. or higher and a strain rate is 1/sec. or more; and thereafter, hot rolling the steel sheet so that the total true strain is 0.7 or more under conditions that a temperature is 1,000° C. or lower and a strain rate is 10/sec. or more, wherein said steel sheet has voids of 0.10 μm or more in size among oxide grains and said voids are dispersed in the interior of the steel sheet.

3. The method for producing a steel sheet according to claim 1 or 2, wherein a density change of the steel sheet from before annealing to after annealing at 850° C. for 20h. in a hydrogen atmosphere is 0.02% or more.

4. The method for producing a steel sheet according to claim 1 or 2, wherein said steel has an aging index of 5 MPa or less.

* * * * *